United States Patent [19]

Manders

[11] 4,290,459

[45] Sep. 22, 1981

[54] BLOWING NOZZLE FOR TRANSPORTING A FLEXIBLE THREAD

[75] Inventor: Petrus G. J. Manders, Eindhoven, Netherlands

[73] Assignee: Ruti-Te Strake B.V., Deurne, Netherlands

[21] Appl. No.: 67,628

[22] Filed: Aug. 17, 1979

[30] Foreign Application Priority Data

Aug. 3, 1979 [NL] Netherlands ..... 7808180

[51] Int. Cl.[3] ..... D03D 47/28

[52] U.S. Cl. ..... 139/435

[58] Field of Search ..... 139/435; 226/97, 7; 239/410

[56] References Cited

U.S. PATENT DOCUMENTS 3,999,579 12/1976 Ohkouchi et al. ..... 139/435

FOREIGN PATENT DOCUMENTS 2900144 7/1979 Fed. Rep. of Germany ..... 139/435

*Primary Examiner*—Henry Jaudon

*Attorney, Agent, or Firm*—Marshall & Yeasting

[57] ABSTRACT

A supply channel for the thread has its exit end surrounded by an annular orifice. A connection is provided for supplying a flowing pressurized fluid to the upstream side of the orifice, and an elongated mixing tube is arranged to receive the thread as well as fluid discharged from said orifice and substantially forms an extension of said channel. A sleeve surrounds only the outflow end portion of the mixing tube, the upstream end of the sleeve having a sealing engagement around the mixing tube, and the downstream end of the sleeve lying in substantially the same plane as the downstream end of the mixing tube. A sleeve-shaped filling piece fills the space between the downstream end portion of the sleeve and the mixing tube and contains axial exhaust channels. A connection is provided for supplying a flowing pressurized fluid to the interior of the sleeve upstream of the filling piece.

4 Claims, 6 Drawing Figures

FIG.1
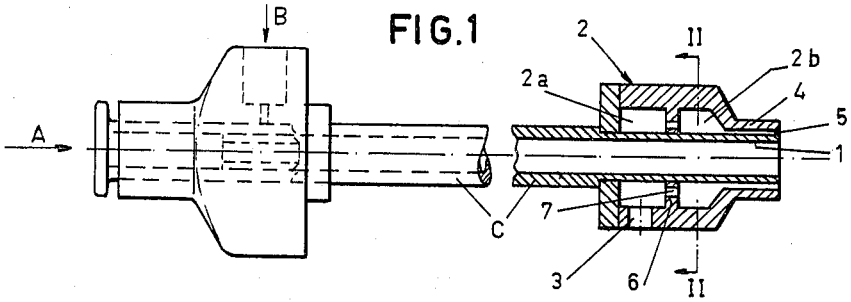
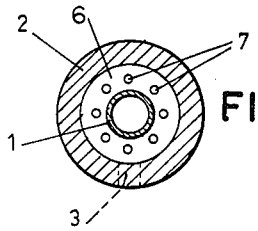
FIG.2
FIG.3
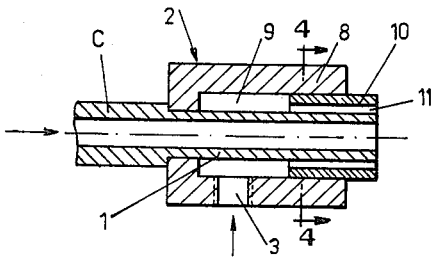
FIG.4
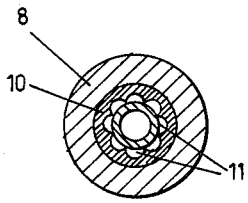
FIG.5
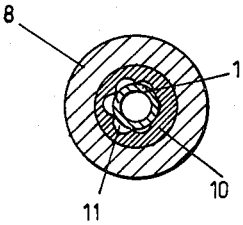
FIG.6
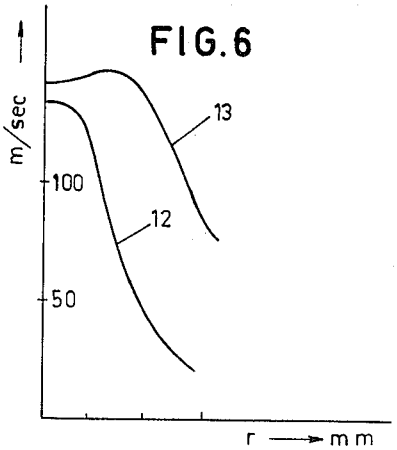

BLOWING NOZZLE FOR TRANSPORTING A FLEXIBLE THREAD

BACKGROUND OF THE INVENTION

The invention relates to a blowing nozzle for transporting a flexible thread, comprising a supply channel for the thread to be transported, the exit end of the channel being surrounded by an annular gap which upstream communicates with means for supplying a flowing pressurized fluid, and in the downstream direction merges with a mixing tube extending substantially as an extension of the supply channel for the thread.

Similar blowing nozzles are generally known. They are e.g. applied to pneumatic weaving machines for sucking in the weft threads by means of pressurized air and entering them into the weaving shed.

Due to all kinds of causes which may be found in the thread itself as well as exteriorly, the head of a thread transported by means of such a blowing nozzle will not always continue after leaving the exit end, along a fixed path (e.g. along the axis of the mixing tube) but variously deviates therefrom. This constitutes an important disadvantage in all those cases in which the thread, after leaving the blowing nozzle, must remain within a narrowly delimited area in order to have the further transport of the thread occur without disturbances. E.g. in a pneumatic weaving machine the head of the thread must be supplied within the cross-section of a tunnel formed in the weaving shed (by means of the reedlamellae or of lamellae especially serving this purpose). A deviation of the optimum path of movement of the thread may e.g. result in that the head of the thread "impacts" against the warp threads which in the relative movement during the previous shed exchange temporarily have caught each other by knotting.

SUMMARY OF THE INVENTION

The invention aims at improving a blowing nozzle of the type as described above in order to thereby impart to a flexible thread to be transported by this nozzle, particularly a weft thread in a pneumatic weaving machine, a greater lateral stabilisation.

This aim is achieved according to the invention in that the outflow end of the mixing tube is surrounded by a chamber connected to an additional source of a flowing pressurized fluid, said chamber communicating with an annular gap situated in or substantially in the plane of the outflow aperture of the mixing tube.

By the measure according to the invention therefore an additional quantity of a flowing pressurized fluid, particularly pressurized air, is supplied in a ring around the exit aperture of the mixing tube. As a result thereof downstream of the exit aperture of the mixing tube the field of high air velocities is considerably extended in the lateral direction so that the thread is exposed, when a deviation in the lateral direction occurs, to a larger resetting force than with a blowing nozzle of the usual type.

In a practical embodiment the chamber is divided into two sections by a radial partition situated at some distance upstream of the outflow aperture of the mixing tube, the upstream section having a connection for the additional pressurized fluid source and the downstream section delimiting an axial, annular shaped channel, which communicates through axial apertures in the partition with the first section.

In a structurally very simple embodiment the chamber is constituted by a sleeve, slid onto the outflow end of the mixing tube and sealingly with its upstream end closing around it, which sleeve delimits with the outflow end an annular space communicating with the connection for the additional pressurized fluid source. A sleevelike filling piece has been slid into the open end of the sleeve, said filling piece being provided with axial outflow channels.

BRIEF DESCRIPTION OF THE DRAWINGS

FIG. 1 shows a side view of a blowing nozzle according to the invention, the end portion of the mixing tube being shown in axial section;

FIG. 2 is a cross-section according to the line II—II in FIG. 1;

FIG. 3 shows an axial section through the end portion of the mixing tube of a blowing nozzle according to the invention in a second embodiment;

FIG. 4 is a section taken on the line 4—4 in FIG. 3;

FIG. 5 is a modification of the embodiment according to FIG. 4, and

FIG. 6 shows a diagram in which for a blowing nozzle of the usual type as well as for a blowing nozzle acording to the invention, the air velocity at various radial distances from the axis of the mixing tube is indicated, i.e. in a plane situated at short distance in front of the exit end of the blowing nozzle.

The portion of the blowing nozzle according to the invention which is shown in elevation in FIG. 1 is of a construction known per se. At A the flexible thread to be transported, e.g. a weaving thread, is supplied, while at B the air necessary for this transport is supplied. At C the so-called mixing tube is indicated within which the thread is surrounded by the transport air jet which is formed, and is propelled thereby.

According to the invention the outflow end 1 of the mixing tube C is surrounded by a chamber 2 which is provided with a connection 3 for an additional source of a flowing pressurized fluid, particularly pressurized air. The chamber 2 merges with a sleeve shaped portion 4 which extends up to the plane of the outflow aperture of the mixing tube and together with the outflow end of the mixing tube delimits an annular gap 5.

In the embodiment of FIGS. 1 and 2 the chamber 2 is divided by a radial partition 6 into two sections 2*a* and 2*b*, the upstream section 2*a* of which contains the connection for the additional air source, the downstream section 2*b* opening into the annular gap 5 around the outflow end of the mixing tube. Both sections 2*a* and 2*b* communicate with each other through axial apertures 7. The radial partition 6 furthers an equal distribution of the pressurized air, which is supplied eccentrically at 3, around the outflow end 1 of the mixing tube.

In the embodiment according to FIG. 3 a simplified construction of the chamber is used. This chamber is substantially formed by a sleeve 8 slid onto the outflow end 1 of the mixing tube, said sleeve sealingly engaging at one end (the left end in the drawing) around the outflow end 1 of the mixing tube C and delimiting together with this outflow end an annular chamber 9 which may be connected via the connection 3 to the additional pressurized air source which is not further shown. A sleevelike filling piece 10 is provided in the end open to the right of the annular chamber 9 around the outflow end of the mixing tube C, said sleevelike filling piece being provided with a plurality of axial channels 11 through which pressurized air, supplied to the annular chamber via the connection 3, may exhaust. The axial channels 11 may have different embodiments. In the embodiment according to FIG. 3 said channels have been provided in the interior circumferential surface of the sleevelike filling piece 10 and have substantially a half-circular cross-section. Said channel cross-sections may all have the same area (as indicated in the construction according to FIG. 4) or have different areas, as indicated in the cross-section according to FIG. 5.

The effect of the provision of the above described chamber around the outflow end of the mixing tube is now further explained with reference to the diagram of FIG. 6. In this diagram the curve 12 shows the variation of the air velocity v in a cross-section just in front of exit exit end of the mixing tube, which at B (see FIG. 1) is supplied with air at a predetermined pressure, namely over the cross-sectional radius r, measured from the axis of the mixing tube.

The diagram clearly shows that the air velocity is maximum in the axis of the mixing tube, said velocity approaching zero adjacent the wall of the mixing tube. A thread moving along the axis of the mixing tube therefore is exposed to a considerably larger air velocity and thereby also to a larger entraining force than a thread moving more eccentrically through the mixing tube.

If now, moreover, the chamber 2 which is provided according to the invention around the outflow end of the mixing tube, is supplied with air at a predetermined pressure, the air velocity in the cross-section under discussion no longer has the course of the curve 12 but of the curve 13. Consideration of the curve 13 shows that the air velocity in the axis of the cross-section under discussion has hardly increased. To the contrary the air velocity remains practically constant in a rather large area of the cross-section under discussion and only decreases close to the wall of the mixing tube. The velocity at which a flexible thread, particularly a weaving thread, is transported by a blowing nozzle according to the invention, therefore will be essentially less dependent on the exact path along which the thread moves than with a blowing nozzle of the usual type. It will be clear that the course of the curve 13 is dependent on the quantity of additional air which is supplied through the chamber 2 around the outflow aperture of the mixing tube. Moreover, it will be clear that the shape of the curve 13, as measured in various radial planes, may vary if, as e.g. indicated in the cross-section according to FIG. 5, at predetermined points around the outflow end of the mixing tube axial channels having a larger cross-section area than at other points are used.

I claim:

1. A blowing nozzle for transporting a flexible thread, comprising a supply channel for the thread, the exit end of said channel being surrounded by an annular orifice, a connection for supplying a flowing pressurized fluid to the upstream side of said orifice, and an elongated mixing tube which is arranged to receive the thread as well as fluid discharged from said orifice and which substantially forms an extension of said channel, wherein the improvement comprises a sleeve which surrounds only the outflow end portion of the mixing tube, the upstream end of the sleeve having a sealing engagement around the mixing tube, and the downstream end of the sleeve lying in substantially the same plane as the downstream end of the mixing tube, a sleeve-shaped filling piece which fills the space between the downstream end portion of the sleeve and the mixing tube and which contains axial exhaust channels and a connection for supplying a flowing pressurized fluid to the interior of the sleeve upstream of the filling piece.

2. A blowing nozzle according to claim 1, characterized in that the axial exhaust channels are provided in the interface between the outflow end of the mixing tube and the sleeveshaped filling piece.

3. A blowing nozzle according to claim 2, characterized in that the axial exhaust channels have been provided as grooves in the circumferential wall of the sleeveshaped filling piece.

4. A blowing nozzle according to claim 3, characterized in that the cross-section of the grooves is larger at one side of the mixing tube than at the other side of the mixing tube.

* * * * *